US007002486B2

(12) United States Patent
Lawrence

(10) Patent No.: US 7,002,486 B2
(45) Date of Patent: Feb. 21, 2006

(54) HIGHWAY VEHICULAR TRAFFIC FLOW CONTROL

(76) Inventor: Malcolm G. Lawrence, Torrells Hall, Willingale, Essex (GB), CM5 OSP ( * ) Notice: Subject to any disclaimer, the term of this patent is extended or adjusted under 35 U.S.C. 154(b) by 371 days.

(21) Appl. No.: 10/450,316

(22) PCT Filed: Dec. 11, 2001

(86) PCT No.: PCT/GB01/05511

§ 371 (c)(1),
(2), (4) Date: Jun. 11, 2003

(87) PCT Pub. No.: WO02/48986

PCT Pub. Date: Jun. 20, 2002

(65) Prior Publication Data

US 2004/0068393 A1 Apr. 8, 2004

(30) Foreign Application Priority Data

Dec. 11, 2000 (GB) ..... 0030068

(51) Int. Cl.
*G08G 1/123* (2006.01)

(52) U.S. Cl. ..... 340/905; 340/995.13; 340/439; 701/117; 701/118; 701/119; 701/23; 701/24

(58) Field of Classification Search ..... 340/439, 340/905, 995.13; 180/167–169; 701/23–25, 701/117–119

See application file for complete search history.

(56) References Cited

U.S. PATENT DOCUMENTS 5,699,056 A * 12/1997 Yoshida ..... 340/905
5,777,451 A * 7/1998 Kobayashi et al. ..... 318/587
5,926,117 A * 7/1999 Gunji et al. ..... 340/988
6,038,502 A * 3/2000 Sudo ..... 701/23
6,249,724 B1 * 6/2001 McCrary ..... 701/24
6,401,027 B1 * 6/2002 Xu et al. ..... 701/117
6,466,862 B1 * 10/2002 DeKock et al. ..... 701/117
6,480,783 B1 * 11/2002 Myr ..... 701/117
6,498,981 B1 * 12/2002 Adams ..... 701/120
6,564,147 B1 * 5/2003 Chen et al. ..... 701/213

* cited by examiner

*Primary Examiner*—Thomas J. Mullen, Jr.
*Assistant Examiner*—Sihong Huang
(74) *Attorney, Agent, or Firm*—Howison & Arnott, L.L.P.

(57) ABSTRACT

A base station receives signals from highway traffic and sends signals to selected vehicles on the highway to command them to increase/decrease speed or charge lane in order to more closely conform to a virtual model for vehicular use of the highway.

10 Claims, 1 Drawing Sheet

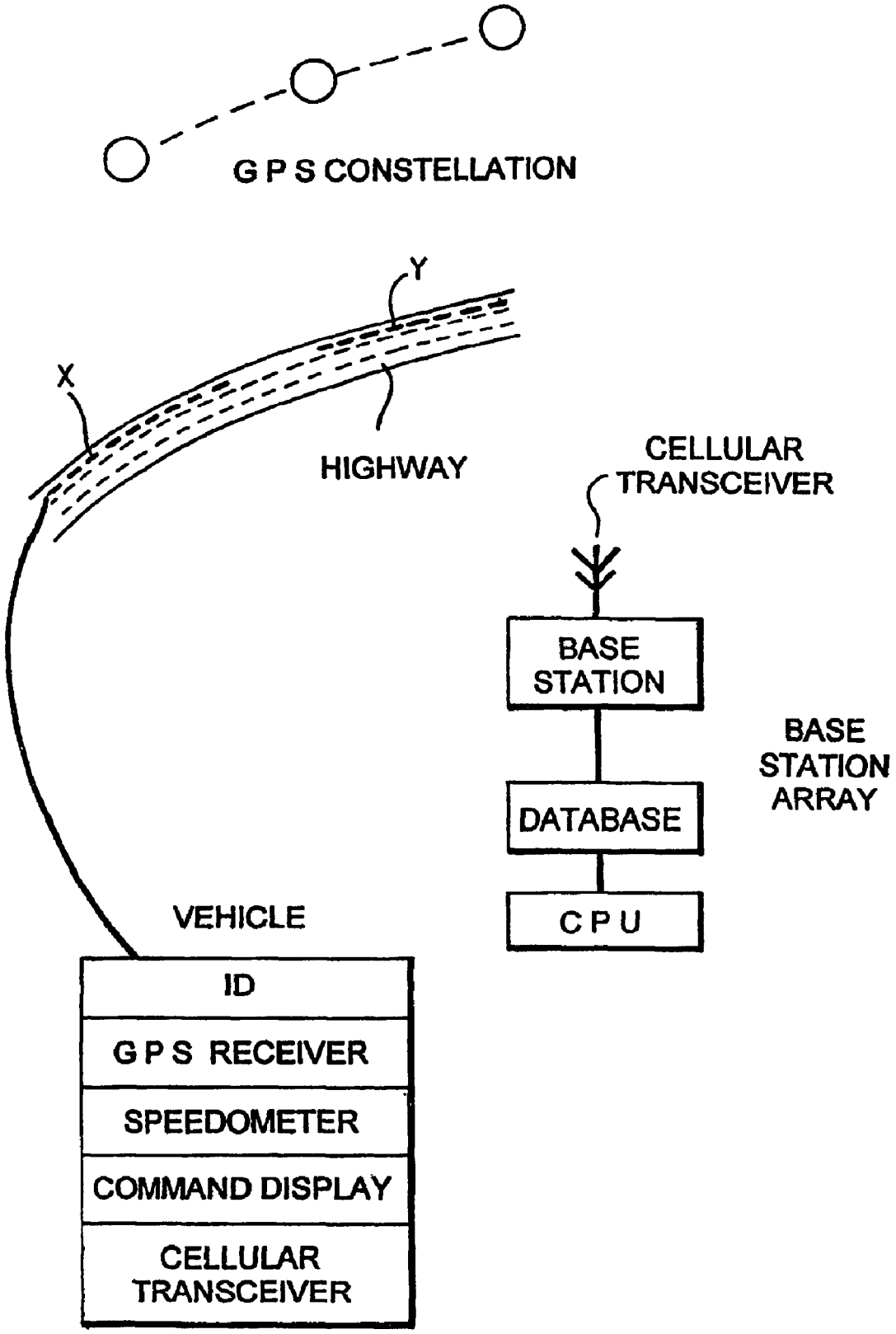
G P S CONSTELLATION
Y
X
HIGHWAY
CELLULAR TRANSCEIVER
BASE STATION
DATABASE
C P U
BASE STATION ARRAY
VEHICLE
ID
G P S RECEIVER
SPEEDOMETER
COMMAND DISPLAY
CELLULAR TRANSCEIVER

HIGHWAY VEHICULAR TRAFFIC FLOW CONTROL

FIELD OF THE INVENTION

The invention relates to road traffic flow control and in particular to a method of road traffic flow control in which real traffic flow is monitored and in which, by signalling individual vehicles with attitude change instructions (affecting vehicle model highway use characteristics) which in aggregate theoretically conform real traffic flow to a computer virtual model representing a flow conforming to an ideal, real flow is adapted as an emulation of the virtual model flow.

BACKGROUND OF THE INVENTION

A highway transmits vehicular traffic as plural discrete (but often almost contiguous) advancing highway traffic capsules each of which comprises plural vehicles which remain relatively static within the respective advancing traffic capsules as the latter are transmitted along the highway. Efficient advancement of a highway traffic capsule, in the sense of maximum safe vehicle volume passage per unit time, requires a balance between vehicle count in the capsule and the speed with which the capsule advances. Efficient traffic flow along a highway requires this balance to be achieved for all traffic capsules on the highway.

In almost all countries, vehicles are largely driven by discretionary driving with enforcement against unacceptable forms of discretionary driving applied punitively as a deterrent which discourages, with varying degrees of effectiveness, only those practices which are considered a threat to highway safety. Advancement of highway capsules in real conditions differs greatly from that model advancement because of the wide freedom of choice which can be exercised by the drivers of different vehicles in practising discretionary driving (regardless of whether choices are exercised on the basis of considered responses to perceived or real driving conditions or on the basis of random discretionary choice dependent upon mood, personal requirements and driver inter-relationship). Vehicle count in a highway capsule, for example, depends on such factors as driver perceptions of safe inter-vehicle distance, visibility, traffic volume pressure and individual speed requirements for the journeys in which individual vehicles and their drivers are engaged. The speed of advancement of a highway capsule is dependent on similar factors, and the two are obviously inter-dependent.

Discretionary driving leads to the presence on a highway of a complex array of different vehicle travel characteristics each resulting from a combination of individual driver attitudes and the influence on them of other driver attitudes and real conditions. That array produces the divergence between real traffic flow and model flow which is experienced in practise.

The array of different vehicle travel characteristics is also responsible indeed for the capsular configuration of highway traffic. A lead vehicle on a highway travels at a speed and in an overall manner decided by the driver of that lead vehicle exercising freedom of choice on the basis of considered responses to perceived or real driving conditions and/or on the basis of random non-rational discretionary choice. That vehicle obliges common lane following vehicles to travel in a manner influenced by the lead vehicle, in particular with respect to speed of travel, with the result that the following vehicles form with the lead vehicle a traffic capsule which advances along the highway but in which the individual vehicles are essentially in stasis with respect to the capsule. Ahead of the capsule are plural other vehicles which form a separate traffic capsule whose travel characteristics are determined by its own lead vehicle. The latter capsule should theoretically merge with the following capsule in due course if the following capsule is advancing at a higher speed. In the alternative, with the most advanced capsule advancing at a greater speed, the inter-capsule spacing will increase so that the two capsules increasingly separate one from the other. Capsules remain intact by acceptance of lead vehicle conduct by following vehicles, either voluntary or compelled by specific highway conditions.

The presence on a highway of the complex array of different vehicle travel characteristics mentioned above is most noticeable on principle routes where space (eg multiple lanes), high speed limits and multiple carriageways which eliminate contra flow conditions accommodate widely ranging exercise of choice in discretionary driving.

The availability of choice to vehicle drivers engenders a number of serious problems which in many cases are as apposite to increasing highway inefficiency as the increasing numbers of vehicles licensed to use the highways. UK motorways (and the broadly similar roads referred to by local nomenclature in other countries) and other principle traffic routes experience a number of sometimes remarkable problems engendered by exercise of choice by vehicle drivers. For example:

1. Spectacles, such as collision spectacles or even construction/repair spectacles, in one carriageway usually act as a virtual traffic flow constriction and give rise to a slowing of traffic in an adjacent carriageway to enable the drivers of the slowing vehicles to observe the spectacle. Slowing can be catastrophic causing multiple vehicle collisions in the carriageway experiencing slow-down. In any event, the deceleration of vehicles generates a deceleration wave as successive vehicles respond to reductions in inter-vehicle distances. Vehicles close in sequence to the lead vehicles may decelerate in a controlled fashion, possibly aided by an alert given by evidence in the adjacent carriageway of the spectacle itself. As driver alertness and vehicles distances vary from one driver/vehicle to another, the highway will inevitably experience the comparatively precipitous deceleration of one or more vehicles, and this produces a tail-back envelope of similarly precipitously decelerating vehicles many of which will decelerate to a speed substantially slower than the lead vehicles with some coming to a standstill. Slow speed conditions of the highway may render it incapable of absorbing extant traffic volume pressures, highway capsules in the tail emanating from the lead vehicles being forced to stasis as they cannot be admitted to more forward parts of the highway. Separate capsules tend to merge on slow-down, reforming with different characteristics and composition and usually again undergoing merger until the virtual constriction has been cleared.
2. The majority of drivers seek speed in the belief that this will result in efficiency of travel. However, data shows that safe vehicle distances at speed mean that a highway capsule progressing at speed s1 and containing n1 vehicles safely distanced at safe distance d1 advances more vehicles per unit time than a capsule progressing at a higher speed s2 and containing a smaller number of vehicles n2 safely distanced at larger safe distance d2.
3. Many divers engage in multiple lane changing upon a perception that different lanes in congested conditions advance at different speeds. However, tests show that multiple lane changing achieves little for the vehicle concerned, accelerates driver fatigue and can slow other vehicles.

4. A lead vehicle in a highway capsule dictates the speed of the capsule. Discretionary driving can thus lead to damage to traffic flow efficiency when a vehicle maintains such a commanding position whilst at the same time advancing at a speed less than the highway conditions will permit. Such a vehicle usually characterises the capsule it leads as one which has a void of unoccupied highway beyond its head.
5. Multiple lane highways usually are configured with the intention or acceptance that different lanes will be used by vehicles of different speed. Thus, for example, a UK motorway has in general three lanes with the outermost lane (on the right) used by relatively fast vehicles in overtaking mode. In relatively congested conditions, such vehicles tend to occupy that lane permanently or semi-permanently in increasing numbers, encouraged by the conviction that this will result in higher average speed for the vehicles concerned, at the expense of traffic volumes in the remaining lanes, particularly the inside lane (on the left). In very many cases, transfer of vehicles to one of those two lanes will enable an increase in the discharge of traffic by the highway as a whole because the two inner lanes are otherwise operating at inefficiently low traffic density with highway traffic capsules having low vehicle counts. This is particularly so where inner lanes are characterised by highway traffic capsules having voids of unoccupied highway beyond their heads.
6. Under jam conditions, the vehicles making up the jam and in common lane form a compacted supercapsule which is in stasis or in crawl with vehicles not in top gear. Removal of the cause of the jam releases the supercapsule which begins to decompact starting at its leading edge. Alert drivers tend rapidly to accelerate during decompaction and are commonly motivated, by a desire to compensate for the delays of the jam, to do so prematurely and excessively. Other drivers do not do so but participate with their vehicles in decompaction in a retired manner which may obstruct vehicles to their rear. Differences in driver attitudes in decompaction cause the fragmentation of the supercapsule to form plural separate traffic capsules in the manner referred to earlier. Under conditions of premature and/or excessive acceleration during supercapsule decompaction, inter-vehicle spacing is tolerated which ordinarily would not be accepted by drivers in exercise of discretionary driving. Indeed, driving is generally effected with a higher than usual degree of recklessness. This at worst predisposes the highway to collisions between vehicles which detract from highway safety and which also engender further jam-producing highway obstruction; at best, this recklessness leads to driver tension which predisposes drivers to precipitous deceleration of one or more vehicles causing production of a tail back envelope of similarly precipitously decelerating vehicles.

SUMMARY OF THE INVENTION

According to the invention, there is provided a method of traffic flow control for a single or multiple lane carriageway of a single or multiple carriageway highway, particularly but not exclusively for a multiple lane carriageway of a multiple carriageway highway, which method comprises (i) defining within a computer a virtual traffic highway use model for a dynamic highway traffic capsule consisting of the vehicles travelling on a selected portion of the length of a lane of the highway, said model comprising a set of highway model use values (eg for individual vehicles or the capsule or sub-capsules within it) comprising, for example, values for dynamic parameter(s) such as values for respective model velocities for the vehicles in the highway capsule and/or values for respective model vehicle module lengths for the same vehicles (the model may also define such highway use values as vehicle lighting, constancy of speed for individual vehicles, acceleration or deceleration for the capsule or for one or more vehicles therein, and position such as constancy of position of vehicles in a lane), (ii) receiving (eg by a signal such as a cellular telephone signal) for (eg from) each of the vehicles in the capsule, real instantaneous highway use values counterpart to the highway model use values of the virtual model, and (iii) signalling (eg by a cellular telephone signal)_each of the signalling vehicles, or one or more (eg each or only one) of selected signalling vehicles, with a command which signifies change to one or more real vehicle highway use values therefor, said commands collectively designed to increase conformity between real traffic highway use for the dynamic traffic capsule and the virtual traffic highway use model and in general signals received by vehicles causing a representation of the commands they signify to be manifested visually or audibly to the driver to which they are addressed.

In the case of a lane carriageway, it will be appreciate that a virtual model for a length of the carriageway of plural lanes constituting part thereof (eg the outer two lanes of a three- or other multiple-lane carriageway) defines a virtual model for a capsule in any particular lane. Such a virtual model for a length of a carriageway or of a length of plural lanes constituting part of the lane composition across the lateral extent of the carriageway expresses a model distribution of vehicles amongst the lanes.

It should be noted that individual vehicles travel at the tail of their own respective vehicle modules, each such vehicle module representing in its length the sum of the vehicle length and the safe stopping distance which must be provided between the vehicle, at its particular speed, and a vehicle ahead.

Signalling from vehicles (signals from roadside detectors being an alternative) to the receiving or base station will conveniently be by cellular telephone transmitter, conveniently forming part of a cellular telephone transceiver, operating on a cellular telephone network such as a private network. Accordingly reception of vehicle transmitted signals by the receiving station may be by cellular telephone receiver, conveniently forming part of a cellular telephone transceiver, operating on a cellular telephone network such as a private network. The transmitter and/or the receiver referred to may conveniently be a 4 G (or UTMS) transmitter or receiver such as a 4 G (or UTMS) transceiver.

Signalling from the receiving or base station to the vehicles will conveniently be by cellular telephone transmitter, conveniently forming part of a cellular telephone transceiver, operating on a cellular telephone network such as a private network. Reception of the receiving station command signals by the vehicles may also conveniently be by cellular telephone receiver, conveniently forming part of a cellular telephone transceiver, with which each vehicle is equipped, operating on a cellular telephone network such as a private network. The transmitter and/or the receiver referred to may conveniently be a 4 G (or UTMS) transmitter or receiver such as a 4 G (or UTMS) transceiver.

Receiving station command signals received at a vehicle conveniently cause actuation of a visual display conveying to the driver a command as to the action a driver should take. Simple displayed commands such as CHANGE LANE, INCREASE SPEED or DECREASE SPEED may be adequate but in practice a command screen will be provided so that a visual representation of a DECREASE SPEED or INCREASE SPEED command (which may be in the form of a coloured lamp output, green perhaps indicating increase and red representing decrease) may be accompanied by a visual data display indicating actual commanded speed. However, simplicity of command interpretation is crucial in order to minimise driver distraction. A suitable command screen may be a liquid crystal display device. An audible signal (eg a tone or voice signal) will be desirable as a command is received in order to alert the driver to the command and thus the apparatus provided on-board for command visual display will conveniently include or be associated with sound generation apparatus such as a tone generator or an audio transducer such as one reproducing voice. The sound generation apparatus may combine the alert signal output with white noise output as alert signals so accompanied have been found to enable the human ear immediately to identify source location so that the driver's eyes are directed to the visual display with maximum speed and minimum mental effort, thus maximising response, minimising driver fatigue and guarding against the risk of demotivating drivers against responsiveness. Further details regarding the combination of alert signals and white noise can be obtained from Sound Alert Technology Ltd and from patent specifications in relation to which that company is a patent applicant.

Vehicle module sizes are required to be disproportionately large at higher vehicle speeds such that vehicle flow rate observing minimum vehicle module lengths is higher as vehicle speeds decrease.

The distances shown in the table below are the shortest stopping distances which are shown in the UK Highway Code for particular vehicle speeds. They assume a nominal automobile (and thus do not distinguish between different makes of vehicle) which is a car in good condition and further assume a dry road (where the conditions are wet, the shortest stopping distances will be larger):

| M.P.H. | Thinking Distance (feet) | Braking Distance (feet) | Overall Stopping Distance (feet) |
|---|---|---|---|
| 20 | 20 | 20 | 40 |
| 30 | 30 | 45 | 75 |
| 40 | 40 | 80 | 120 |
| 50 | 50 | 125 | 175 |
| 60 | 60 | 180 | 240 |
| 70 | 70 | 245 | 315 |
| 80 | 80 | 320 | 400 |

It will be understood from the above that in practice, when observing safe inter-vehicular spacing, vehicle flow rate past a point decreases as vehicle speed increases. For example, at 60 mph, capsule speed is twice that at 30 mph but vehicle module length is increased to 240/75 with the result that the capsule progresses at greater speed but its density is so reduced that the overall flow-past of vehicles is significantly less.

It will, of course, be clear that, in the case of a highway enjoying low traffic concentration, the objective of achieving individual driver speed aspirations, within controls, is feasible at the expense of traffic flow rate whereas, under high traffic load conditions the objective must be to maximise flow since inadequate overall flow will inevitably in such conditions lead to the congestion which is characteristic of an available flow demanded flow discrepancy.

Accordingly, in low density traffic conditions, the virtual model may, and usually will, be one designed to accept high speed since overall flow rate is less of a concern than it is in high density conditions. The virtual model in such a case will thus in practise often be one in which all the component vehicles are travelling forward at maximum lawful speed with the inter-vehicular spaces the minimum safe distances for that speed. The virtual model capsule as an ideal, however, is a capsule designed to maximise the quantum of traffic flow as represented by the rate of displacement forward along the road of the dynamic traffic capsule.

Alternative sub-ideal model capsules will in practice be designed for particular purposes and particular situations. For example, a capsule may be travelling at a speed of 50 mph determined by a lead vehicle whose driver has determined to travel at that speed, perhaps because it suits his driving style or journey requirements, the inter-vehicular spacing within the capsule representing safe distances in case one or more of the vehicles should need to stop (or rapidly slow down). Removal of the lead vehicle from the head of the capsule permits the second vehicle to increase speed, say to 70 mph. Its doing so results in that second vehicle pulling away from the rest of the capsule. Having done so, the spacing between the second vehicle and the third vehicle will have increased eventually to one permitting the third vehicle to match the new higher speed of the second vehicle; similar results are achievable by withdrawing vehicles from intermediate positions in the capsule. In this way, individual vehicle higher speed aspirations may be accommodated, provided traffic density allows it, so that individual vehicles may travel faster. The base station in such circumstances will have information indicating that traffic density will permit such an accommodation of individual driver speed aspirations, such information having been determined by the volume of individual vehicles on the highway, or in particular lanes thereof, reporting their ID's and travel characteristics. Having such information, the base station determines a suitable virtual model for the capsule concerned which accommodates such speed aspirations and commands the vehicles in the capsule to change travel characteristics so as to conform with the virtual model (although, of course, conformity will in practice likely at best be an approximation to the virtual model). The first command in such circumstances will, of course, be to the first vehicle to command it to pull over (and thus leave the capsule, or alternatively to command it to pull forward with increased speed so as to distance itself from the rest of the traffic capsule; of course, the subsequent vehicles may increase speed automatically as a response to the stepwise pulling away of a forward vehicle rather than each requiring a command to do so.

Signals from capsule vehicles may include information indicating (i) vehicle type normally including speed and acceleration capability, (ii) vehicle ID usually inclusive of registration details for the purposes of applying legal remedies for non-compliance with base station commands and (III) vehicle length.

Model capsule length is as a minimum in practice the sum of the respective lengths for the respective vehicles therein, respective safe following distances for the respective vehicles at respective model vehicle velocities (which may or may not be approximately the same) and usually also a margin for error. A real capsule compared to the virtual model may be composed of identifiable sub-capsules each of which qualifies as a capsule in its own right but is not treated as such for the purposes of the method of the invention. It will be appreciated that, as noted above, individual vehicles travel at the tail of their own respective vehicle modules, each such vehicle module representing in its length the sum of the vehicle length and the safe stopping distance which must be provided between the vehicle, at its particular speed, and a vehicle ahead (and usually also a margin for error, as intimated above). The respective lengths for the respective vehicles may be nominal lengths for the respective vehicles (conforming to maximum car size), although there must be provision for identifying exceptions to a nominal length figure which covers less than all vehicle types (recognising, for example, that a truck/lorry may be very substantially longer than any car as well as having less stopping power in most cases). The respective safe following distances for the respective vehicles at respective model vehicle velocities are conveniently respective nominal safe following distances for the respective vehicles at respective model vehicle velocities.

The respective lengths for the respective vehicles may more appropriately be the actual lengths for the respective vehicles, respective vehicle signals received at a receiving station providing a code from which such length can be determined for the respective vehicle by means at the base station.

The respective safe following distances for the respective vehicles at respective model vehicle velocities are most conveniently the actual safe following distances for the respective vehicles at respective model vehicle velocities and respective vehicle signals received at a receiving station may conveniently provide a code from which such safe following distances can be determined for the respective vehicle by means at the receiving station.

It will readily be understood from the foregoing that increased conformity between real traffic highway use and model use requires a change in individual vehicle highway use. In the case of a first traffic capsule lagging a second traffic capsule, the lead vehicle in the first traffic capsule can be signalled to accelerate or to pull over, to the adjacent lane in the case of a multiple lane single direction carriageway or to a side-of-road parking provision in other cases.

In the case of an acceleration demand signal, or a signal having acceleration as an option for compliance, signalling to a following vehicle in the same capsule is most conveniently effected in response to increased spacing between the following vehicle and that ahead of it (eg resulting from acceleration or pulling over of the forward vehicle). Simultaneous acceleration demand signals to vehicles in sequence may be dangerous due to different response times as between one vehicle and another, and simultaneous pull-over demand signals may similarly lead to poor highway conduct.

In high traffic load conditions for any particular lane, traffic redistribution over plural lanes may be desirable either to increase overall flow of traffic or to enable satisfaction of individual vehicle speed aspirations whilst not deleteriously affecting overall flow rate. In the latter case, it is desirable to cause redistribution out of fast lines. In such cases, redistribution can be accomplished by signals demanding lane change. Usually, such signals should be directed to selected vehicles rather than randomly. Selectivity may be on the basis of absolute position in the capsule concerned. For example, vehicles relatively forward in the capsule are vehicles whose redistribution to another lane will advantage most other vehicles in the capsule simply because a forward vehicle by definition has more following vehicles. However, in general, it appears that export of plural vehicles from selected positions in the capsule is most advantageous to produce a generally even dilution in lane traffic density. Selection in practice will also take account of the capacity of particular locations in an adjacent importing lane to absorb exported vehicles from particular positions in the exporting lane. Of course, lane redistribution may have for its objective efficient use of lanes other than a fast (ie outermost) lane.

In a further aspect of the invention, there is provided a method of road traffic flow control which method comprises receiving signals from the respective vehicles in transit on a road, said signals indicating the velocity of the respective vehicles and their respective locations relative to other vehicles, determining the traffic flow demand on the road posed by the traffic in transit on the road, signalling to the vehicles on a road a command signal when the demand is not satisfied by the instantaneous condition of the traffic flow on the road to adjust vehicle velocities to change inter-vehicle position so that the vehicles travel with increased conformity with respect to a model in which the vehicles are disposed in transit at minimum safe inter-vehicle distances and travel therein at velocities which are the maximum for those distances.

BRIEF DESCRIPTION OF THE DRAWING

FIG. 1 illustrates a disclosed embodiment of the invention.

DETAILED DESCRIPTION OF THE DISCLOSED EMBODIMENT

As shown in the single FIGURE of the accompanying drawings, a three-lane highway includes two traffic capsules, of which parts X and Y only are shown, comprising plural vehicles. The vehicles are equipped with an ID memory, a GPS receiver (or similar device for determining global position of the so-equipped vehicle), a speedometer, a cellular telephone transceiver and a command display. The base station is equipped with a cellular transceiver, a database and a CPU. The vehicles individually signal the base station cellular transceiver, via the vehicular cellular transceiver, with vehicle ID, position and speed. ID for particular vehicles includes type (in sufficient detail to enable the base station to recognise regulatory speed limitations applicable to the vehicle and vehicle acceleration/speed capacity), vehicle length (from which the base station can calculate vehicle module length) and registration details (so that non-compliance with commands given by the base station can be dealt with by legal remedies). Position includes position relative to vehicle ahead and highway lane identity. Proximity-sensing devices for determining position relative to vehicle ahead and position relative to highway edges may be provided alternatively or additionally to the GPS receiver. The base station CPU compares traffic capsule highway use with a virtual model stored in the base station database and sends command signals to the vehicles for display to direct drivers to eg change speed or lane so as more closely conform actual to model use.

The following Examples are intended to illustrate the invention by way of example only, the vehicle signalling equipment and base station equipment in each Example being as described above with reference to the FIGURE:

EXAMPLE 1

A capsule A of vehicles comprising twenty five cars of various sizes and types is advancing along a lane of a three-lane carriageway at a speed of 59 mph. The capsule is lead by a car C1 (having a speed of 59 mph). The capsule occupies the outside lane of the carriageway. Beyond the head of the capsule is the tail car C2 of a further capsule B advancing at a speed of 64 mph. Car C1 has signalled its position, speed and essential ID (including type and registration details) to a base station as has car C2 and the other cars in the capsule and the base station has determined the required vehicle module lengths and the excess space if any between the vehicles in the capsule at the respective vehicle speeds. The base station has further determined that the capsule A is lagging the capsule B by 0.6 miles.

The base station signals car C1 to display a command to increase speed to a limit, which will be 70 mph in the case of UK highway law, or to pull over to the centre lane. Car C1 in fact accelerates to 63 mph and has also pulled over to the centre lane of the highway within 0.5 mile. The balance of the capsule responds by the cars which were to the rear of the car C1 immediately accelerating to a speed of 70 mph, thus conforming to a computer model for the capsule requiring it to progress at that speed. Capsule B is similarly treated to conform it to the same model. Legislative changed may permit conformity with temporary models which call for a temporary speed of more than 70 mph (perhaps only marginally more than 70 mpg) in order for Capsule A to close the gap with Capsule B to the point where the two capsules have merged to form a larger Capsule A/B (thus making more efficient use of the available highway).

EXAMPLE 2

A capsule $A^1$ of vehicles has the composition of capsule A in Example 1 except that one of the vehicles is a truck T12 positioned at position 12 in the capsule.

The capsule is advancing in the outside lane of a three-lane carriageway at a speed of 53 mph. Capsule B advances away from the head vehicle in capsule $A^1$ at a speed of 64 mph. The instantaneous lag of capsule $A^1$ to the rear of capsule B is 0.6 miles.

The lead vehicle A1 in capsule $A^1$ is signalled by the base station to increase speed to a limit equal to the approximate maximum for cars on dual-carriageway roads (eg 70 mph) or to pull over. Once it has done either, the base station is programmed successively to signal the following vehicles capable of the limit speed to do the same, transmitting such signals in response to a trigger operating when the distance between a signalled vehicle and the next in sequence along the travel path of the latter reaches a predetermined threshold or when the signalled vehicle leaves the capsule by pulling over (thus creating infinite distance between the two vehicles along the travel path of the second). The vehicle A1 accelerates. When the distance between vehicle A1 and the next following vehicle exceeds the safe following distance for the speed of the following vehicle, that following vehicle is also signalled by the base station to accelerate to the limit speed or to pull over to the centre lane. The base station continues to signal vehicles in the capsule $A^1$ in a similarly controlled fashion responsive to inter-vehicle spacing. Truck T12 is, however, signalled to pull-over to the centre lane. Truck T12 has indicated its essential identity in its signals to the base station and the base station recognises from this information the vehicle type as indicating a vehicle which should not travel at the limit speed and thus does not signal truck T12 with a signal which allows the option of acceleration.

EXAMPLE 3

Two traffic capsules A and B are travelling on a highway as noted in Example 1 but there are also Capsules C to J ahead of Capsule B forming a total of five pairs of capsules all related to one another as are Capsules A and B in Example 1 and each capsule pair being spaced from the next by 0.7 miles. The capsules travel in the outer lane of the southbound carriageway of the highway. In the northbound carriageway, an accident has occurred and the traffic there is in stasis. As Capsule J approaches the virtual constriction represented by the stationary traffic in the northbound carriageway, slow-down will ordinarily begin to occur as the accident spectacle is observed by a portion of the drivers in the outer lane of the southbound carriageway. The stasis in the northbound carriageway has, however, been recognised by the base station as a result of signals received thereby (eg from slow vehicles in that carriageway). Its response is to reconfigure the virtual models for the Capsules A to J in anticipatory manner. Because it is impossible to force drivers completely to ignore a spectacle, they cannot effectively be signalled to increase speed (or not to slow down) so that vehicle speed is at a point where observation is impractical. However, the extreme slowing down of a minority of drivers in a capsule (each of which breaks up the capsule and slows vehicles to the rear to the speed of the slow vehicle concerned) can be abated by command by partial slowing. The drivers in Capsule J are therefore signalled in advance of the virtual constriction to slow to a speed at which the risk of collision through spectacle observation is reduced and a signal expressly indicates the occurrence of an accident in the northbound lane so that observation motivated by the desire actually to determine whether there has been an accident is neutralised. Capsule I is signalled simultaneously to slow down. The same applies to the remaining Capsules A to H. Once the virtual constriction has been passed by a capsule, the vehicles therein are signalled immediately to increase speed.

EXAMPLE 4

Two traffic capsules A and B are travelling on a highway as noted in Example 1. The configuration and travel characteristics of the capsules are as set forth in Example 1 except that the base station, having determined the required vehicle module lengths for the vehicles in Capsule B, has determined that there is excess space between all the vehicles in Capsule B at the respective vehicle speeds within the capsule. The capsule thus fails to conform to the virtual model stored in the base station computer. The base station signals all the vehicles in Capsule B so that they increase speeds momentarily so as to dose the inter-vehicle gaps so that the vehicle module lengths are contiguous. As a result Capsule B conforms itself to the virtual mode, in so doing decreasing in capsule length and distancing itself further from the following Capsule A. The base station signals car C1 in Capsule A to increase speed or to pull over to the centre lane. Car C1 accelerates and has pulled over to the centre lane of the highway within 0.5 mile. The balance of the capsule responds by the cars which were to the rear of the car C1 immediately accelerating to an increased speed, thus conforming to a computer model for the capsule requiring it to progress at that speed. If the above-mentioned following cars, however, do not accelerate quickly enough, they will be signalled to do so (or to pull over to allow the other capsule members to do so and to advance), and equally should they dose to much, they will be signalled to decelerate to compensate.

EXAMPLE 5

A supercapsule progresses in an outside traffic lane of a three-lane carriageway at modest speed with the vehicles generally at safe distances. However, the centre lane is almost empty of traffic and in addition the vehicles in the outside lane repetitively close to unsafe inter-vehicular spacing. The base station signals to every fifth vehicle in successive 0.5 mile lengths of the supercapsule that it must change lane to the centre lane. On changing lane, the traffic density in the outer lane is substantially reduced enabling the vehicles therein increase speed, the vehicles in so doing dosing inter-vehicular spacing and forming separate capsules. Those transferring to the centre lane rapidly increase speed and also form separate traffic capsules. The overall result is greater road use, increased flow of traffic, reduced driver frustration, reduced demands upon driver concentration and decreased accident potential.

EXAMPLE 6

A triple lane carriageway has plural vehicles forming plural capsules in each lane. Capsule C in the outer lane proceeds efficiently and approximates its virtual model. It is seen, however, that as Capsule C proceeds it will be likely to need to be disturbed by commanding several vehicles to separate to the centre lane and that this may be prevented by excess traffic in that lane. The base station signals selected vehicles in Capsule C to separate to the centre lane but only after calculating the virtual model for a capsule in the centre lane which will accommodate this transfer, signalling selected vehicles in that latter-mentioned capsule to transfer to the inner lane and determining that the centre lane capsule has conformed to its virtual model.

What is claimed is:

1. A method of highway traffic flow control which method comprises receiving at a receiving station from each vehicle in a traffic capsule consisting of the vehicles travelling in a direction along a selected length of a lane of a carriageway, respective signals which signify actual highway travel characteristics for the signalling vehicle in use of the highway, comparing the highway travel characteristics of the capsule with a highway use virtual model for said capsule, and signalling one of more selected vehicles in said capsule with a command which signifies a change in at least one vehicular highway travel characteristic, said commands collectively designed to conform the actual highway travel characteristics for the capsule to those of the virtual model.

2. A method as claimed in claim 1 wherein said respective signals from said vehicles in said traffic capsule signify the instantaneous global position of the signalling vehicle and its identity and type.

3. A method as claimed in claim 1 wherein said respective signals from said vehicles in said traffic capsule signify respective vehicle module lengths for the vehicles therein and respective vehicle velocities for the same vehicles, and wherein the highway use model comprises a set of highway model use values including values for respective model velocities for the vehicle in the traffic capsule and values for respective model vehicle module lengths for said vehicles.

4. A method as claimed in claim 1 wherein the model is designed to maximise the quantum of traffic flow as represented by the rate of displacement forward along the road of the highway traffic capsule.

5. A method as claimed in claim 1 wherein the respective model vehicle module lengths are in each case the sum of the length of the vehicle in question, the safe following distance for that vehicle at vehicle velocity in relation to the vehicle which it follows and a margin for error.

6. A method as claimed in claim 5 wherein the respective lengths for the respective vehicles are the actual lengths for the respective vehicles and wherein respective vehicle signals received at said receiving station provide a code from which such length can be determined for the respective vehicle by means of the receiving station.

7. A method as claimed in claim 5 wherein the respective safe following distance for the respective vehicles at respective model vehicle velocities are the actual safe following distances for the respective vehicles at respective model vehicle velocities and wherein respective vehicle signals received at said receiving station provide a code from which such safe following distances can be determined for the respective vehicle by means of the receiving station.

8. A method as claimed in claim 5 wherein the respective lengths for the respective vehicles are nominal lengths for the respective vehicles.

9. A method as claimed in claim 5 wherein the respective safe following distances for the respective vehicles at respective model vehicle velocities are respective nominal safe following distances for the respective vehicles at respective model vehicle velocities.

10. A method of traffic control comprising signalling vehicle(s) on a carriageway to signify to drivers thereof to change speed or traffic lane in order to conform the use of the carriageway to a virtual model of an ideal pattern of use of the carriageway by the vehicles using it, the vehicle signalling a base station with signals signifying the characteristics of their actual use of the carriageway and the base station comparing actual use by the traffic with the virtual model before signalling the vehicle(s), signals received by the vehicle(s) causing a representation of the commands they signify to be displayed visually or manifested audibly to the driver.

* * * * *